US006802162B1

(12) United States Patent
Fisher

(10) Patent No.: US 6,802,162 B1
(45) Date of Patent: Oct. 12, 2004

(54) CONSTRUCTION BLOCK AND METHOD

(76) Inventor: Myles A. Fisher, 2006 E. Mallory St., Pensacola, FL (US) 32503

( * ) Notice: Subject to any disclaimer, the term of this patent is extended or adjusted under 35 U.S.C. 154(b) by 0 days.

(21) Appl. No.: 10/002,190

(22) Filed: Nov. 28, 2001

(51) Int. Cl.[7] ..... E04C 1/42

(52) U.S. Cl. ..... 52/306; 52/172; 52/745.19; 65/58

(58) Field of Search ..... 52/306, 309.1, 52/105, 171.3, 172, 307, 786.1, 745.19; 65/58

(56) References Cited

U.S. PATENT DOCUMENTS 1,991,469 A * 2/1935 Slayter ..... 52/306
2,158,089 A * 5/1939 Slick ..... 52/306
2,167,764 A * 8/1939 Lytle ..... 52/307
2,392,552 A 1/1946 Roe ..... 72/41
2,532,478 A * 12/1950 Bridges ..... 52/306
5,139,595 A 8/1992 Taylor ..... 156/104
5,160,566 A * 11/1992 Ashby et al. ..... 156/252
5,333,427 A * 8/1994 Uhlik ..... 52/306
5,553,440 A 9/1996 Bulger et al. ..... 52/786.13
6,039,390 A 3/2000 Agrawal et al.
6,260,317 B1 * 7/2001 Fisher ..... 52/306

* cited by examiner

*Primary Examiner*—Carl D. Friedman
*Assistant Examiner*—Naoko Slack
(74) *Attorney, Agent, or Firm*—Peter Loffler

(57) ABSTRACT

A construction block which has improved thermal insulation qualities, has improved sound transmission migration reduction properties, and which reduces or outright eliminates the effects of a seam failure. The construction block is comprised of a pair of generally parallel faces joined by a plurality of sides. At least one baffle is disposed within the interior chamber and is located along the weld seam that joins the two body member halves of the construction block. A desiccant or insulation gas, or both can be disposed within the interior chamber of the block.

23 Claims, 3 Drawing Sheets

CONSTRUCTION BLOCK AND METHOD

BACKGROUND OF THE INVENTION

1. Field of the Invention

The present invention relates to a construction block having good insulation and fault-tolerant properties and a method for creating the construction block.

2. Background of the Prior Art

Construction blocks are typically but not necessarily rectangular members having a pair of faces joined by four sides. These blocks, which are use to build partition structures, are usually transparent or translucent and may have a texture pattern on the faces. The outer surface of the blocks may be smooth or may have an appropriate mechanism for joining the block to other blocks. U.S. Pat. No. 5,595,033 to Frey, U.S. Pat. No. 5,588,271 to Pitchford and my U.S. Pat. No. 5,778,620 are examples of such mechanisms. The blocks, which are made from glass, plastic or a similar material, are typically formed as two generally identical halves welded together forming a seam.

These construction blocks, which enjoy wide popularity in the construction industry, have several areas that can benefit from improvement. Although, modern construction blocks have a relatively high level of thermal insulation and sound insulation capability, these levels can always withstand being raised. Another problem with present construction blocks is found in seam failure. A small hole along the seam not only reduces the insulation properties of that block but also serves as in introduction point for moisture to enter the interior chamber of the block. The moisture within the block condenses and becomes unsightly. The moisture introduction is exacerbated by the bellowing effect created by the block due to the difference in temperature between the block face on the interior of the building and the temperature of the block face on the exterior of the building which is exacerbated by the cycling of the construction block due to the heating of the block due to the relative heat of the day and the cooling of the block due to the relative coolness of the night.

Therefore, there is a need in the art for a construction block that addresses the aforementioned shortcomings of the present-day blocks. Such a construction block must have improved thermal and sound insulation properties and must limit the adverse effects of a failed seam.

SUMMARY OF THE INVENTION

The construction block and method of the present invention addresses the aforementioned needs in the art. The construction block increases the thermal efficiency and sound insulation of the block. The construction block also attacks the moisture problem experienced from a failed seam by outright eliminating the condensation within the interior chamber of the block or by isolating the condensation from the sight of a user. The bellowing effect—which tends to pull air from the exterior of the block into the interior chamber of the block through the pinhole in the welded block seam is reduced. A method of increasing the thermal efficiency or eliminating the condensation is also disclosed.

The construction block of the present invention is comprised of a pair of body members each having a face joined by a plurality of side edges with inwardly directed side portions, edge portions of the side portions in abutting relationship with the edge portions of the other body member and joined by a welded or adhesive seam defining an interior chamber. A baffle having an outer periphery is located within the interior space and disposed generally parallel with the pair of faces and along the seam, to form two separate areas within the interior chamber whereby a bellow effect of the faces is reduced. The baffle has an upwardly turned up edge and the one or both of the body members has a recessed section for receiving the turned up edge Means for joining the construction block with other construction blocks, may but need not be provided.

An appropriate desiccant, an insulation gas, or both are disposed within the interior chamber of the construction block. The desiccant lies at the bottom of the construction block out of sight of a user. At least one opening can be provided on the block for introduction of the desiccant or insulation gas, the opening being airtight sealed after introduction. Alternately, at least one weakened area, which may or not be perforated, may be provided on the construction block. The weakened area can be punched by a screwdriver or similar instrument for creating the opening. A locator mark can be provided on the block in the area defined by the weakened area for easy and consistent location of the weakened area. Alternately, the locator mark can be provided on the block (without the block having a weakened area) so that a person can drill an opening at the locator mark. The opening, weakened area, or locator mark can be located on at least one of the faces, on at least one of the sides or both. By providing these members on the side of the block, the sealed opening will not be visible to a user.

The baffle or a face of the block may have an appropriate coating, such as an optical or heat reflective coating, thereon.

The baffle serves several important roles. The baffle adds additional thermal insulation capacity and sound insulation capacity to the construction block. The baffle reduces the bellow effects created by the inner positioned face and the outer positioned face. The baffle separates the interior chamber into two or more sub-chambers. For example, by placing two baffles into the interior chamber, one baffle on one side of the seam and the other baffle on the other side of the seam, the interior chamber is separated into three sub-chambers. Therefore, any moisture and the resulting condensation that is introduced into the construction block through a failure in the seam is isolated within the middle sub-chamber out of sight of a user. Lastly, the baffles may be used to add to the overall aesthetic qualities of the block by coming in different colors, patterns including light diffusing patterns, smoked appearance, etc.

BRIEF DESCRIPTION OF THE DRAWINGS

Similar reference numerals refer to similar parts throughout the several views of the drawings.

DESCRIPTION OF THE PREFERRED EMBODIMENT

Figure 3:
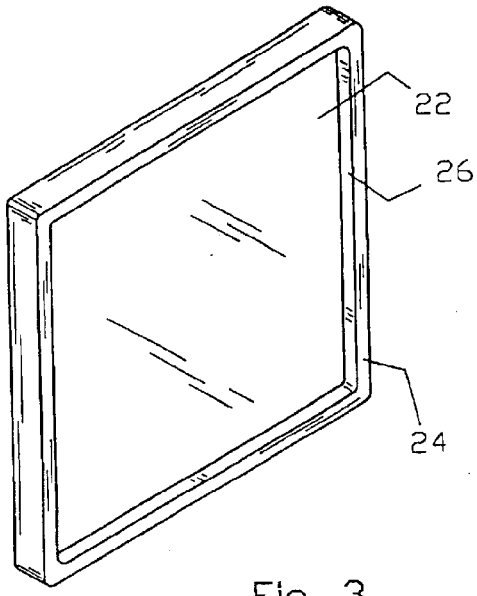
FIG. 3 is a perspective view of the baffle used with the construction block.
Figure 4:
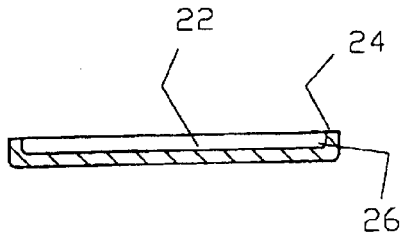
FIG. 4 is a sectioned view of FIG. 3.
Figure 1:
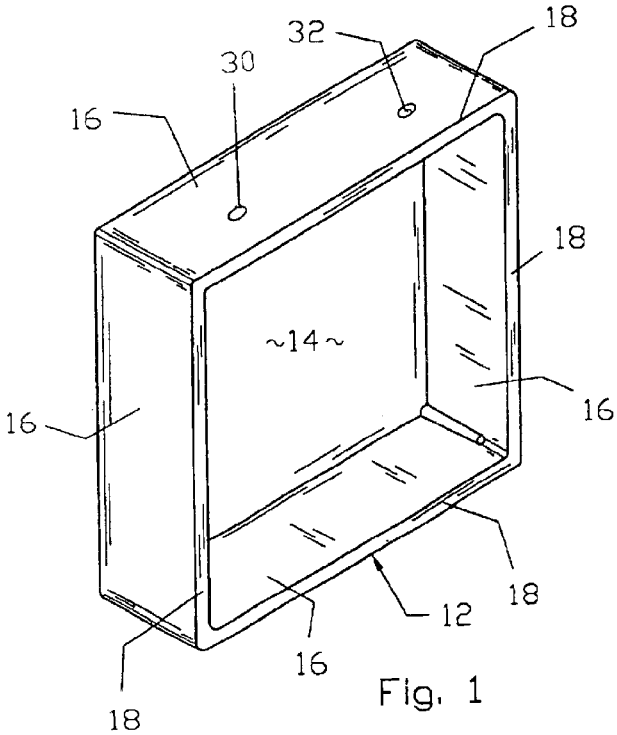
FIG. 1 is a perspective view of one of the body members of the construction block of the present invention.
Figure 2:
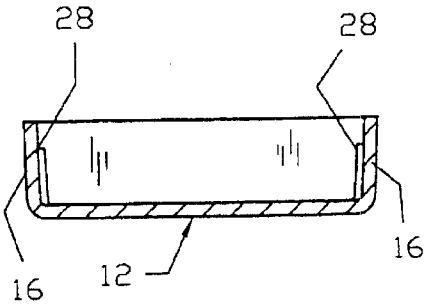
FIG. 2 is a sectioned view of FIG. 1.
Figure 5:
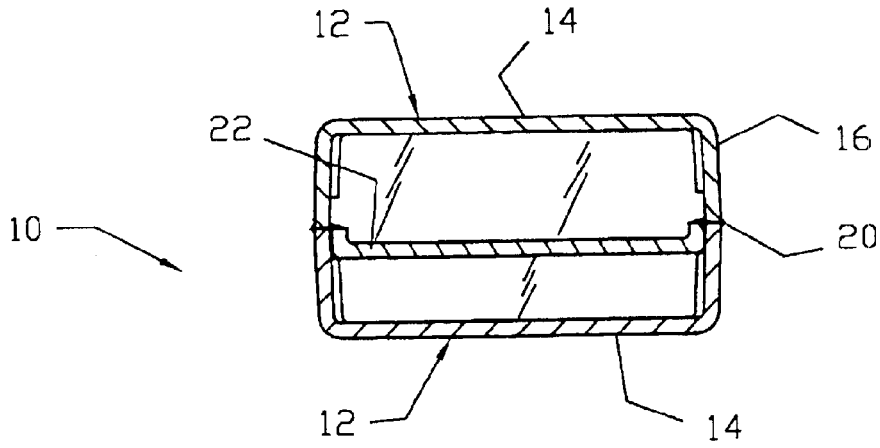
FIG. 5 is a sectioned view of the construction block of the present invention in final form.
Figure 6:
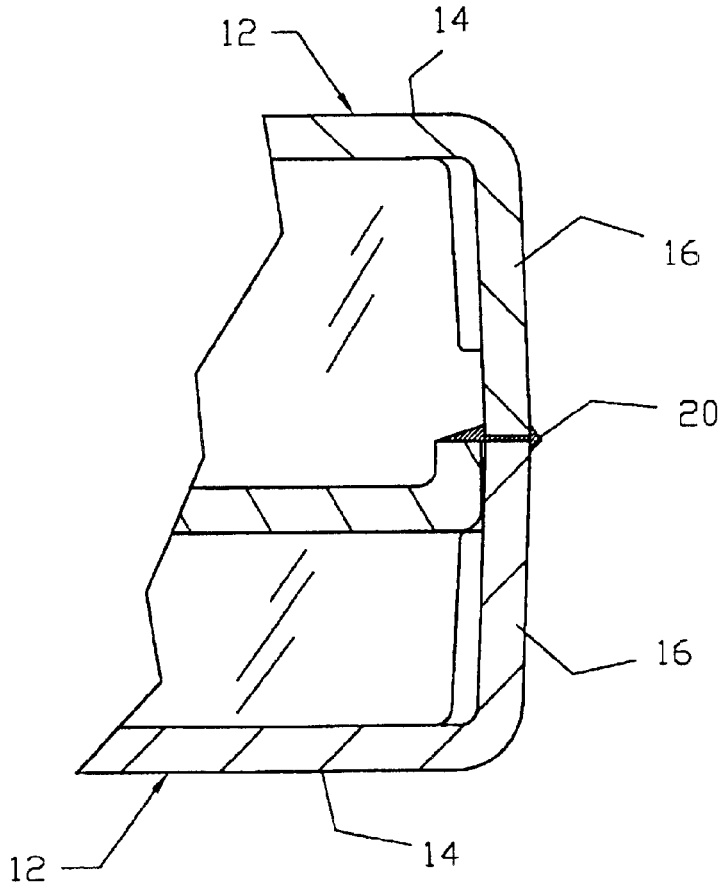
FIG. 6 is a close-up view of a portion of the weld seam welding the two body members and the baffle together.
Figure 7A:
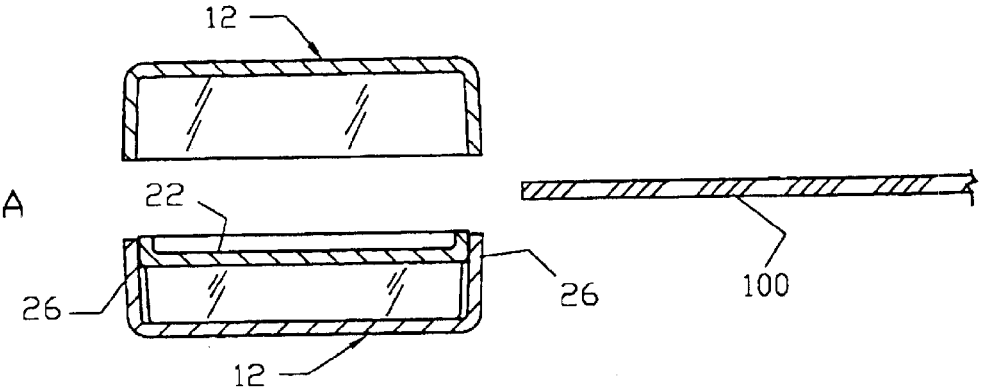
FIG. 7A illustrates the two body members, one with the baffle received within its recessed portion coming together.
Figure 7B:
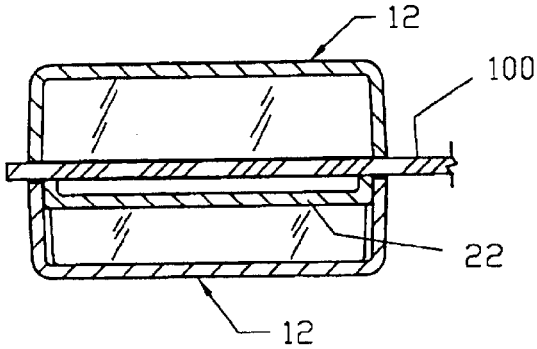
FIG. 7B illustrates the heating plate of the heat welder coming in contact with the joined body members of FIG. 7A.
Figure 7C:
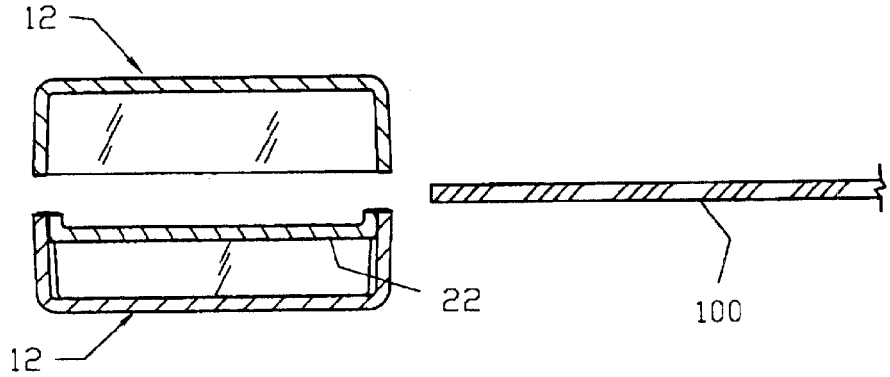
FIG. 7C illustrates the heating plate of the heat welder retracting.
Figure 7D:
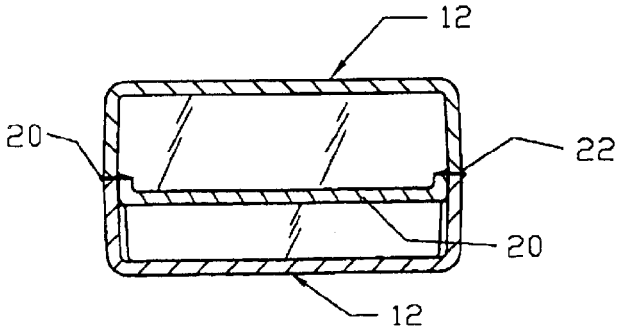
FIG. 7D illustrates the two body members being joined together after being acted upon by the heat welder.

Referring now to the drawings, it is seen that the construction block and method of the present invention, generally denoted by reference numeral 10, is comprised of a generally rectangular body that is formed from two similar body members 12 each having a face portion 14 with inwardly directed side portions 16, edge portions 18 of the side portions 16 in abutting relationship with each other and joined by a welded or adhesive seam 20 to define an airtight fashion interior chamber. The airtight joiner of the two body members 12 can be accomplished in appropriate fashion such as by heat welding the two halves along the seam 20, etc. It is expressly understood that the construction block 10 can be constructed in a shape other than rectangular, and having other than four sides, in keeping within the scope and spirit of the present invention. The outer surface of the construction block 10 can be generally smooth, or can have any appropriate structure for joining the construction block 10 to other construction blocks 10. The faces 12 of the construction block 10 can be transparent, translucent, or opaque. The face portion 14 may also have an appropriate textured surface, such as a wave pattern, column pattern, etc., if desired. The body members 12 are formed from an appropriate resin material, such as acrylic, polycarbonate, copolymers, etc.

A baffle 22 having an outer periphery 24 is located within the interior chamber of the joined body members 12 and is disposed generally parallel with the pair of faces 14 and along the seam 20, to form two separate areas within the interior chamber whereby a bellow effect of the faces 14 is reduced. The baffle 22 may have an upwardly turned up edge 26 and one or both of the body members 12 has a recessed section 28 for receiving the turned up edge 26.

In order to create the construction block 10 of the present invention, the baffle 22 is positioned within the interior chamber of the two body members 12. If one or both of the body members 12 has a recessed section 28, the baffle is seated therein. The two body members 12 are brought together such that the respective edge portions 18 abut one another along a seam 20. A heating plate 100 of a welder is pressed upon the seam 20 in order to simultaneously act on the two body members 12 and the baffle 22. The heating plate 100 melts the outer edges 18 of each body member 12 and the outer periphery (upwardly turned edge 26, if used) of the baffle. The heating plate 100 is retracted and the two body members 12 are pressed together such that the outer edges and the outer periphery of the baffle 22 is heated welded together in air tight fashion. By using an upwardly turned edge 26 on the baffle 22, the heat welding will not affect the plane of the baffle 22. The baffle 22, melted to the inner surface of one or both body members 12, will form two separate airtight subchambers within the construction block 10.

Each baffle 22, or a face of the block, preferably an interior face, can be provided with an appropriate coating such as an optical or a heat reflective coating on one or both surfaces. This coating can be used to control the effects of the sun, such as an ultraviolet light barrier coating or can be a visual coating, such as a tint, a color, or a reflective surface in order to change the overall appearance and/or thermal efficiency created by the construction block 10. By placing the coating on the baffle 22 or an interior face of the block 10, the coating is safely sealed within interior of the construction block 10 so that it cannot be scratched or otherwise tampered with.

Disposed within the interior chamber of the construction block 10 can be an appropriate desiccant for absorbing any moisture within the interior chamber. As the desiccant will fall to the bottom of the interior chamber, it will not be readily visible even in a construction block 10 having transparent faces 14. Alternately, or in addition to the desiccant, an insulation gas may be disposed within the interior chamber. The insulation gas is chosen from the group consisting of argon, krypton, xenon, or combinations thereof or any other insulating gas or combination thereof.

In order to introduce the desiccant or insulation gas into the interior chamber, the construction block 10 may be formed with at least one opening 30 located thereon. The opening 30 can be located on at least one of the faces 14, on at least one of the sides 16, or both. After the desiccant or insulation gas is introduced into the interior chamber, each opening 30 is sealed airtight in any appropriate fashion. Alternately, at least one weakened portion can be provided on at least one of the faces 14, on at least one of the side edges 16, or both. The weakened portion may be punched out with a screwdriver, drill or other similar tool and the desiccant or insulation gas introduced through the opening thus created. Again, after the desiccant or insulation gas is introduced into the interior chamber, each opening is airtight sealed in any appropriate fashion. A locator mark 32 can be provided on the area encompassed by the weakened portion for easy location of the weakened area. Alternately, the locator mark 32 may be provided on any appropriate portion of the construction block 10 so that the area identified by the locator mark 32 may be drilled to provide a consistent location for the opening for introduction of the desiccant or insulation gas. Again, after the desiccant or insulation gas is introduced into the interior chamber, each opening is airtight sealed in any appropriate fashion.

While the invention has been particularly shown and described with reference to an embodiment thereof, it will be appreciated by those skilled in the art that various changes in form and detail may be made without departing from the spirit and scope of the invention.

I claim:

1. A construction block comprising:

a body formed from a resinous material, the body formed by a pair of face portions with inwardly directed side portions, edge portions of the side portions in abutting relationship and joined by a welded or adhesive seam defining an interior chamber; and a baffle having an outer periphery, completely located within the interior chamber and disposed generally parallel with the pair of faces and the entire outer periphery of the baffle attached along substantially the entire seam, to form two separate areas within the interior chamber whereby a bellow effect of the faces is reduced.

2. The construction block as in claim 1 wherein the outer periphery of the baffle has a upwardly turned up edge.

3. The construction block as in claim 2 wherein the body has a recessed section for receiving the turned up edge.

4. The construction block as in claim 1 further comprising an opening located on the baffle.

5. The construction block as in claim 1 further comprising a desiccant disposed within the interior chamber.

6. The construction block as in claim 1 further comprising an insulation gas disposed within the interior chamber.

7. The construction block as in claim 6 wherein the insulation gas is selected from the group consisting of argon, krypton, xenon or combinations thereof.

8. The construction block as in claim 1 further comprising at least one locator mark located on the construction block.

9. The construction block as in claim 1 further comprising at least one weakened portion located on the construction block.

10. The construction block as in claim 1 further comprising at least one opening located on the construction block.

11. The construction block as in claim 1 further comprising an optical coating or heat reflective coating disposed on the baffle or on one of the face portions of the block.

12. A method for forming a construction block comprising the steps of:

providing a first body member formed from a resinous material, the first body member formed by a first face portion with inwardly directed first side portions with first edge portions;

providing a second body member formed from a resinous material, the second body member formed by a second face portion with inwardly directed second side portions in abutting relationship with the first side portions;

providing a baffle having an outer periphery;

positioning the baffle within the interior space of the joined first body member and second body member, the baffle disposed generally parallel with the first face portion and the second face portion and along the joined first side portions and the second side portions, to form two separate areas within the interior chamber whereby a bellow effect of the faces is reduced;

welding the joined first side portions and the second side portions.

13. The method as in claim 12 wherein the welding is accomplished by heat welding.

14. The method as in claim 12 wherein the outer periphery of the baffle has a upwardly turned up edge.

15. The method as in claim 12 wherein the first body member has a recessed section for receiving the turned up edge.

16. The method as in claim 12 wherein an opening is located on the baffle.

17. The method as in claim 12 wherein a desiccant is disposed within the interior chamber.

18. The method as in claim 12 wherein an insulation gas is disposed within the interior chamber.

19. The method as in claim 18 wherein the insulation gas is selected from the group consisting of argon, krypton, xenon or combinations thereof.

20. The method as in claim 12 wherein at least one locator mark is located on the construction block.

21. The method as in claim 12 wherein at least one weakened portion is located on the construction block.

22. The method as in claim 12 wherein at least one opening is located on the construction block.

23. The method as in claim 12 wherein an optical coating or heat reflective coating is located on the baffle or on the first face or the second face.

* * * * *